United States Patent [19]

Sarpy, Jr.

[11] Patent Number: 4,941,804

[45] Date of Patent: Jul. 17, 1990

[54] PLASTIC MULTI-RING PAPER BINDING SYSTEM USING ONE PIECE COVER

[76] Inventor: John B. Sarpy, Jr., 2717 Ridgelake Dr., Metairie, La. 70002

[21] Appl. No.: 344,219

[22] Filed: Apr. 27, 1989

[51] Int. Cl.[5] ..... B42B 5/10

[52] U.S. Cl. ..... 412/7; 281/15.1; 281/21.1; 281/27.1; 281/51; 402/80 P; 402/80 R; 402/70; 402/73; 402/75; 402/502; 412/43

[58] Field of Search ..... 281/51, 15.1, 21.1, 281/27, 27.1, 27.2, 27.3, 29; 402/80 R, 80 P, 60, 70, 71, 72, 73, 74, 75, 76, 502; 412/6, 7, 43

[56] References Cited

U.S. PATENT DOCUMENTS

| | | | |
|---|---|---|---|
| 2,176,314 | 10/1939 | Russell | 281/27.1 |
| 2,407,656 | 9/1946 | Emmer | 281/27.1 |
| 2,891,552 | 6/1959 | Trussell | 402/75 X |
| 4,120,517 | 10/1978 | Staats | 281/27.1 |

FOREIGN PATENT DOCUMENTS 2527522 2/1983 France .

*Primary Examiner*—Paul A. Bell

*Attorney, Agent, or Firm*—Pravel, Gambrell, Hewitt, Kimball & Krieger

[57] ABSTRACT

A binder apparatus for use in binding together sheets of paper, each correspondingly pre-apertured with multiple openings along a margin includes a three panel one piece cover with a front and rear cover connected by a smaller cover spine portion with parallel scores defining respectively pivotal connections between each of the covers and the spine portions. A plastic ring-type binder includes a spine having an inner concave surface and an outer convex surface and parallel side portions, one side portion having multiple closely spaced flexible rings extending therefrom each with a single free end portion. One or more elongated adhesive bead member extends along the plastic spine convex surface and positioned adjacent the scores and the spine end portions thereof, bonding the spine to the cover set at the cover spine portion thereof.

7 Claims, 3 Drawing Sheets

PLASTIC MULTI-RING PAPER BINDING SYSTEM USING ONE PIECE COVER

BACKGROUND OF THE INVENTION

1. Field of the Invention

The present invention relates to book/booklet bindings that can be quickly assembled 37 in house", and more particularly relates to an improved booklet binding system having an internally and anchored positioned plastic multi-ring-type binding element mounted to a three-panel one-piece cover using preferably adhesive mounted entirely interiorly of the cover and spaced therealong so that the one-piece cover when folded can completely cover and hide the plastic binding element, and the papers bound thereto, leaving the cover set exterior surfaces free for printed matter and the like.

2. General Background

For the sake of simplicity and quick categorizing, all binding of printed material can be classified into three groups. Firstly, there is permanent binding such as is used on library books, dictionaries, and hard back books.

A second type of binding is semi-permanent binding which uses a popular commercially available plastic multiple ring spine binding together both the internal papers and the cover set (i.e., front and rear cover panels), wherein the contents can be released with changes being made prior to distribution.

A third type of binding system is known as loose leaf binding which typically is associated with three-ring books used for school work, price lists, catalogs and other releases which are intended for supplementation, deletion and/or changes on an ongoing basis. If the document to be distributed will not be supplemented, it is indeed questionable as to the justification for housing material in a three-ring binder. A drawback to a three-ring binder-type system is the vunerability of the sheets to release from the limited security of three-hole engagement.

Many commercially available binding systems of the temporary binding style provide cover sets with internally concealed metal or plastic rings to engage the loose leaf material. A common example is the three-ring binder which uses a metallic three-ring structure usually riveted to the cover set, which includes a three-panel cover—namely, a front and rear cover with a smaller back or spine portion connecting the front and rear cover together with scores therebetween.

Another type of loose leaf binder is the two-hole or three hole fastener which includes generally front and rear cover panels with internal pages that are secured together with metallic bendable tabs that are inserted through the cover pieces as well as the loose leaf pages.

A commercially available binding system is the aforementioned plastic spine binding system which uses a plurality of very closely spaced multiple plastic rings (e.g., 19 rings for 11" margin) integrally attached to a plastic spine member. With this type of binding system, both the front and rear cover as well as the loose leaf papers are punched with a series of closely spaced-apart rectangular openings. The plastic multi-ring binder element is visable since it necessarily holds the two piece (front and rear) cover set as well as the loose leaf paper.

Plastic multi-ring binding element systems are commercially available. One of the larger manufacturers of such binding systems is the General Binding Corporation of Northbrook, Ill. Their binding products are sold under the mark "GBC". Binding systems manufactured and sold under the mark "GBC" include electric binding machines, manual binding machines, and combination punch and bind machines. General Binding Corporation sells plastic bindings which include various ring diameters such as, for example, small diameters of three sixteenths inches (3/16") for holding a capacity of twelve (12) sheets and large diameter rings of two inches (2") for example, for binding in excess of 400 sheets of paper. Two-piece cover sets are used as front and rear covers for the binding with plastic binding members having multiple spaced-apart rings, such as, for example, nineteen (19) ring systems, when the sheets are bound on eleven inch (11") binding margin.

The problems with plastic binding systems having two-piece cover sets include handling, filing, stacking, storing and an unpresentable appearance. The exposed unprotected plastic is an unprofessional looking binding system that is unfit and/or undesirable for many types of books and presentations. Further, the plastic spine member provides a curved or convexed outer surface which is often difficult/expensive to print. Printing on the spine or element back is desireable so that contents/-name of the book can be identified by examining the spine as the book rests on a shelf or in a stack. Further, the two-piece cover set in combination with the plastic multi-ring binder provides a document which can be difficult to stack and store because the paper is almost invariably much thinner than the diameter of the ring.

GENERAL DISCUSSION OF THE PRESENT INVENTION

The present invention solves these prior art problems and shortcomings in a simple, straightforward manner. The present invention provides a cover and binder apparatus for use in binding together sheets of preaperatured paper with multiple openings spaced along a margin. The apparatus includes a one piece cover that includes front and rear cover panel connected by a smaller panel spine portion. A pair of parallel scores or hinges define respectively connections between each cover and the spine portion so that the covers can fold upon each other both during binding and during use. A plastic ring-type binder having a curved spine with an inner concave surface and an outer convex surface is provided. The plastic ring-type binder includes parallel side portions, one side portion having multiple closely spaced flexible rings extending therefrom, each with a single free end portion. The rings have a memory or flex which returns them to assume a generally circular configuration after the rings are opened as occurs during the addition of perforated paper thereto. One or more adhesive bead members or like attachment extend along the plastic spine convex outer surface and between the spine end portions thereof, binding the spine to the cover set at the cover spine portion thereof.

In the preferred embodiment, each adhesive bead or like attachment extends transversely with respect to the plastic spine longitudinal axis so that the adhesive bead is thickest on each side of the longitudinal axis.

In the preferred embodiment, the adhesive bead extends substantially the full length of the plastic spine.

With the present invention, the cover and the plastic binding element can be of differing materials.

In the preferred embodiment, the bead is positioned substantially between and parallel to the pair of scores.

In another embodiment the bead or like attachment is adjacent and parallel the back cover score.

In the preferred embodiment, the bead member is confined to the inner surface of the cover spine portion, so that printed matter can be added to the outer surface of the cover spine and without communication between such printed matter and the bead.

With the method of the present invention, an improved method of binding the margins of perforated paper to a cover set is provided wherein a plastic ring-type spine having an outer convex surface, an inner concave surface, and end portions is provided with a row of multiple, closely-spaced binding rings. The method includes the connecting of the cover set and plastic ring-type spine together and before the assembly of perforated paper to the rings, using preferably a chemical bonding bead that is positioned between the cover and the plastic binding element back and without substantial flow of the chemical bonding bead to the exterior surface of the cover. After this assembly is perfected and allowed to set, perforated paper can be added to the plastic binding element rings even though the one piece, three panel cover is attached thereto. This eliminates the prior art steps of perforating the cover set and then adding the front and rear covers to the ring bound material.

BRIEF DESCRIPTION OF THE DRAWINGS

For a further understanding of the nature, objects, and advantages of the present invention, reference should be had to the following detailed description, taken in conjunction with the accompanying drawings, in which like reference numerals denote like elements, and wherein.

DETAILED DESCRIPTION OF THE PREFERRED EMBODIMENT

Figure 1:
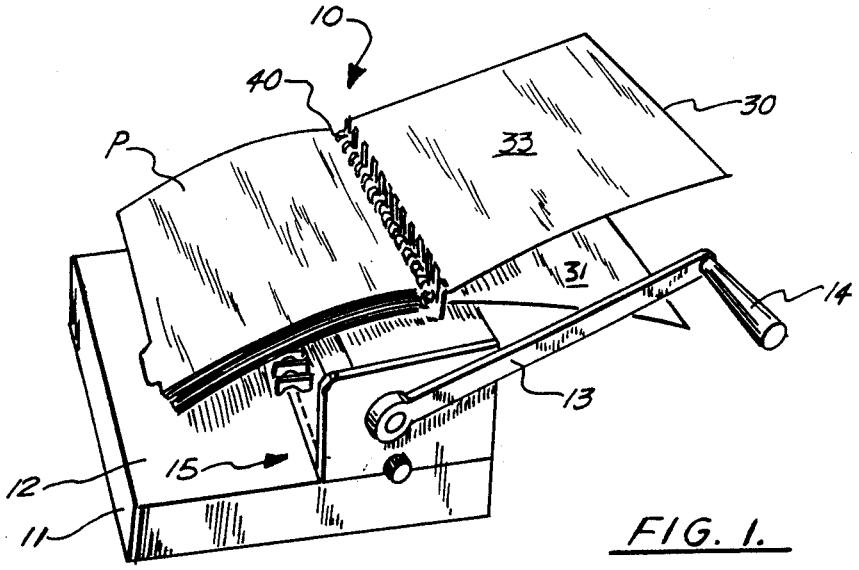
FIG. 1 is a perspective view illustrating the system of the present invention.
Figure 2:
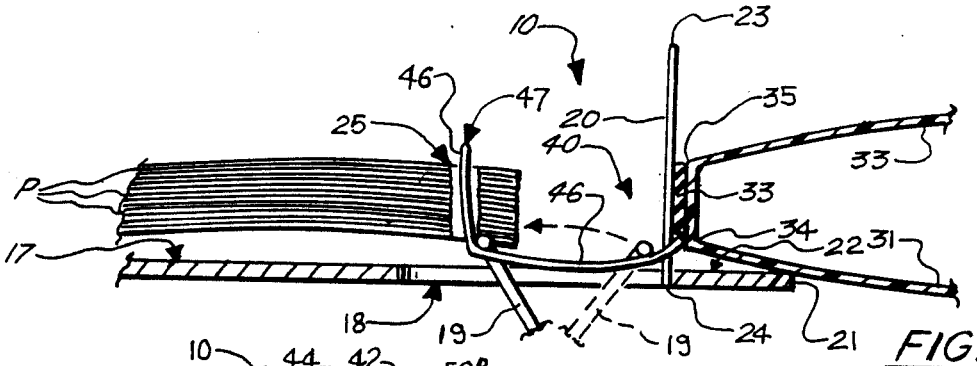
FIG. 2 is a fragmentary sectional view illustrating the preferred embodiment of the apparatus of the present invention during the assembly of loose leaf perforated papers thereto.
Figure 3:
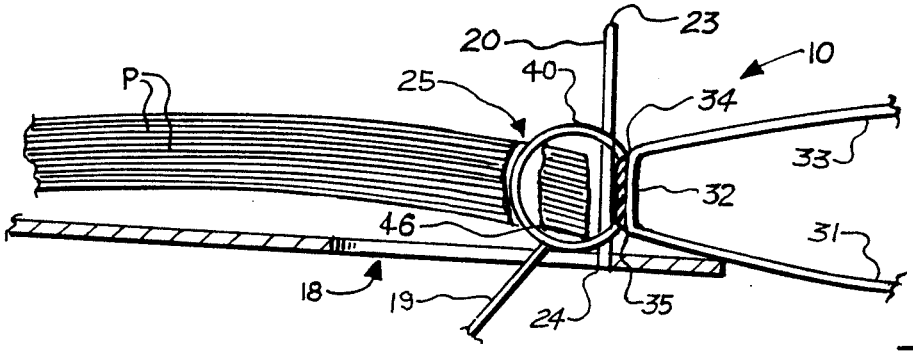
FIG. 3 is a schematic sectional view of the preferred embodiment of the apparatus of the present invention showing the loose leaf papers and ring spine after assembly and with the cover set in a folded binding position.
Figure 4:
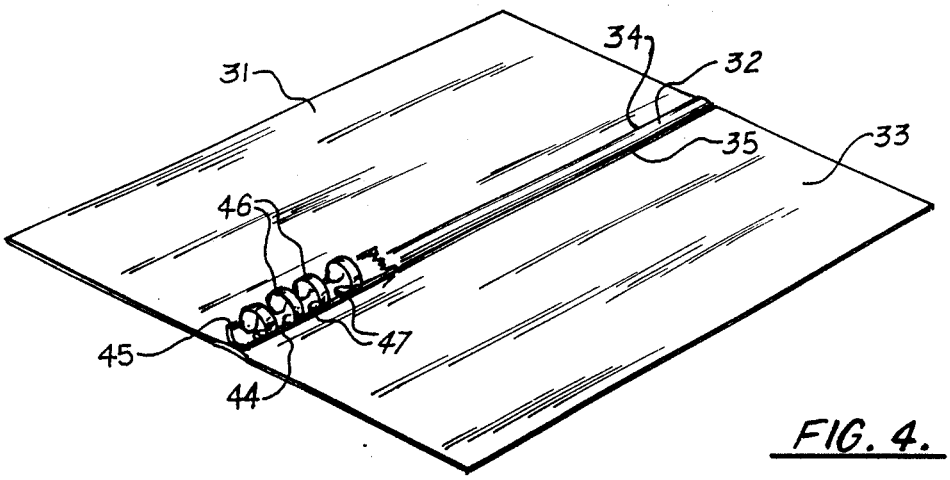
FIG. 4 is a perspective view of the preferred embodiment of the apparatus of the present invention.
Figure 5:
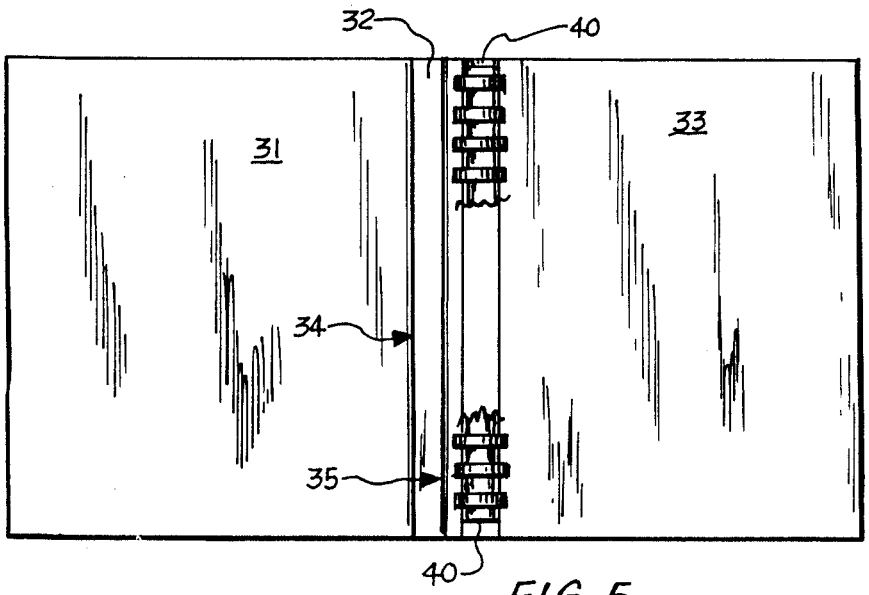
FIG. 5 is a plan view of an alternate embodiment of the apparatus of the present invention.
Figure 6:
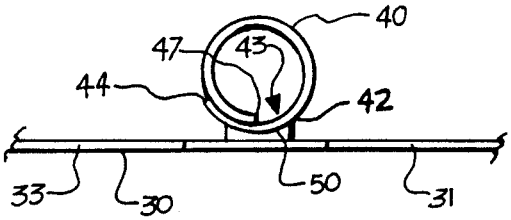
FIG. 6 is a sectional bottom view of the preferred embodiment of the apparatus of the present invention.
Figure 7:
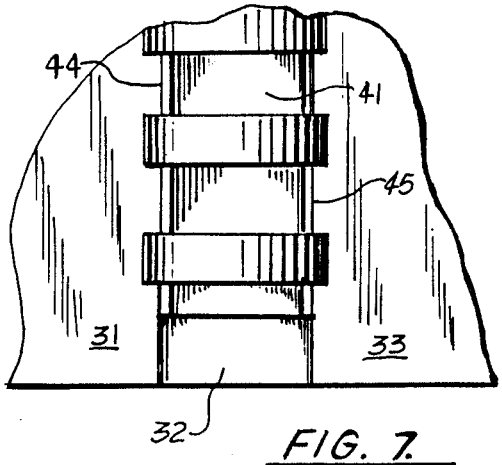
FIG. 7 is an enlarged fragmentary view illustrating the preferred embodiment of the apparatus of the present invention in plan.
Figure 8:
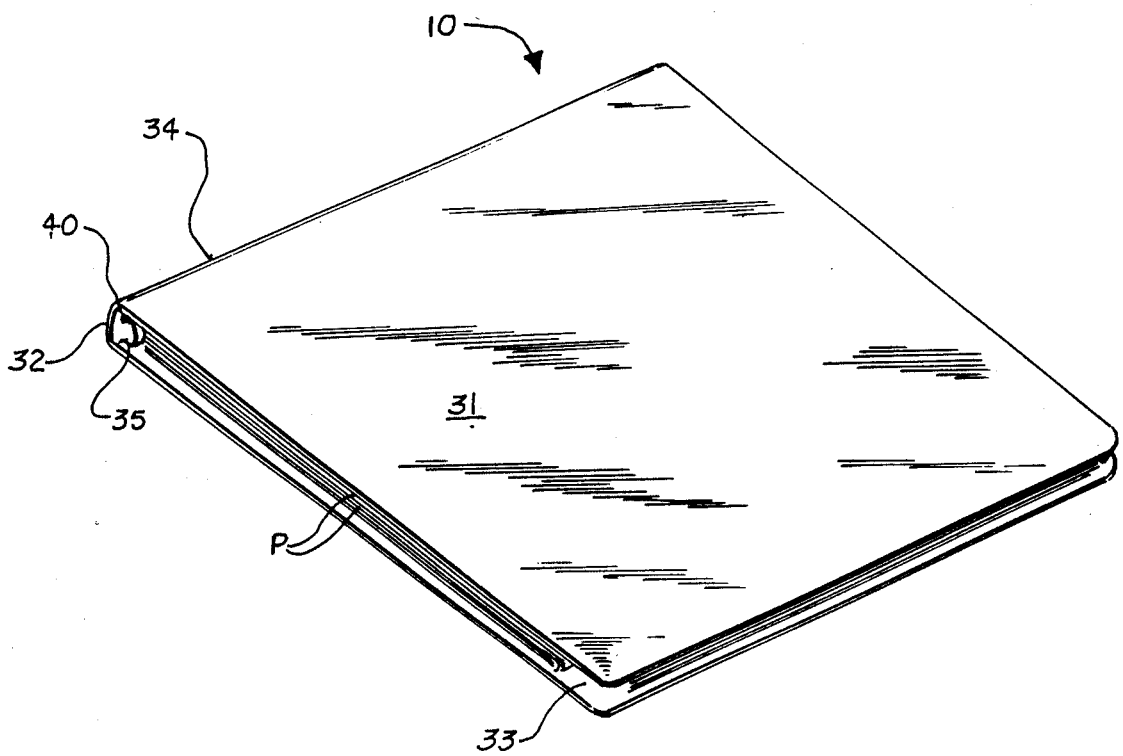
FIG. 8 is a perspective view of the preferred embodiment of the apparatus of the present invention illustrating its appearance in a folded, closed position.

FIGS. 1-3 illustrate the system of the present invention as used with a conventional binding machine 11. The binding system 10 of the present invention can be used with a punching and binding machine 11 which is commercially available, such as is manufactured by General Binding Corporation. Punching and binding machine 11 includes a base 12 and can include an operating members, such as lever arm 13 having handle 14. Slot 15 is provided for loading a plurality of sheets of paper into the apparatus 11 for punching. Indexing member 16 defines the hole positions. Upper plate 17 carries a binding apparatus which includes a plurality of slots 18, each occupied by an ell-shaped finger 19. Vertical retainer pins 20 act as a "comb" in combination to hold a plastic ring type binder element 40 in position when the plurality of ell-shaped fingers 19 stretch the flexible rings 46 (see FIG. 2).

Upper surface 17 of binding machine is unencumbered in the region aft vertical retainer pins 20. Thus, rear plate member 21 is flat and unencumbered providing a planar upper surface 22. Each post 20 includes an upper free-end 23 and a lower end 24 that attaches to the upper plate 17.

A one piece cover 30 includes a front cover 31, a rear cover 33, and a connecting spine 32. Scores or hinges 34, 35 include a front cover hinge and a back cover hinge, each generally parallel to one another and define the connection between the spine portion of the cover 30 and the respective front and rear covers 31, 33. The material for one piece cover 30 can be plastic, cardboard or a laminate as examples.

Plastic ring binding element 40 includes a longitudinally extending rectangular element back 41 having an outer convex surface 42 and an inner concave surface 43. Side portions are provided on the longitudinal rectangular element back 41 including a straight edge portion 44 and a discontinuous edge portion 45 which carries rings 46. Each ring 46 is flexible and has a rounded distal end portion 47 which is used to penetrate the slots 25 in paper P being bound. An elongated adhesive bead 50 is positioned generally parallel to and between the scores 34, 35 and extends substantially the length of the cover set spine 32. In the preferred embodiment, the adhesive bead 50 extends the length of plastic ring binding element 40 longitudinal rectangular element back 41. As can be seen by an inspection of the transverse view of FIG. 2A, the bead 50 is thicker (when viewed laterally) at its edge portions 50A, 50B in order to create a good bond between the convex surface 42 of the ring spine 40 and the cover spine inner surface 36. The cover spine portion 32 can be a flat planar surface in contrast to the convex surface 42 of the plastic ring spine 40. This difference in curvatures is greatest with smaller ring diameters. Thus the system of the present invention solves the problem of providing a one piece cover economically securing a plastic ring binding element, and over a large span of ring diameters.

Figure 2A:
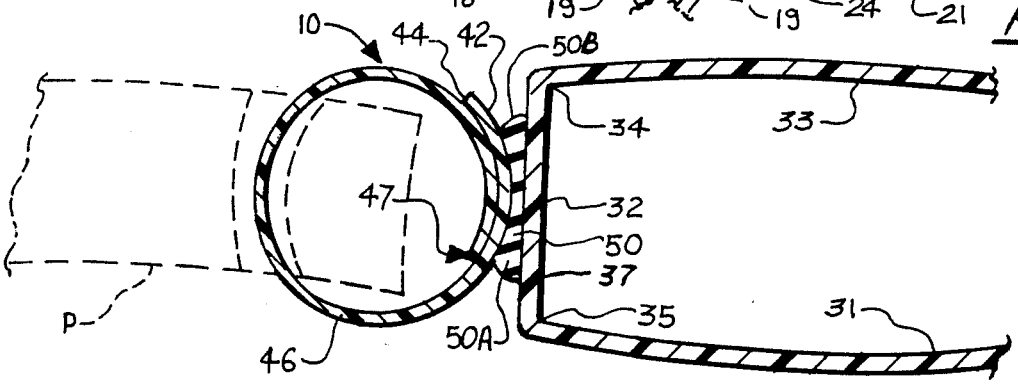
FIG. 2A is an enlarged fragmentary view illustrating the preferred embodiment of the apparatus of the present invention.

In FIGS. 2, 2A, and 3, it can be seen that the above-discussed structure provides a binding system which can totally hide the plastic ring binding element 40 yet can be used on conventional binding machines 11. During the binding process, the covers 31, 33 are simply folded rearwardly in a direction away from plastic ring spine 40. The plastic ring binding element 40 is attached to the cover 30 prior to the binding process. This is in contrast to the present commercial method of affixing holes to both the interior paper pages P, and to the covers (i.e. a front and a rear cover). The rings must be first opened and then an assembly of the cover sets and pages is completed in the prior art. Thus, Applicant provides an improved method in that the cover set 30 is attached to the plastic ring spine 40 prior to an assembly of pages P thereto. This provides an apparatus which has a very clean professional appearance, which increases binding speed and efficiency, which allows spine printing to be attached to the exposed outer surface 37 of the cover set spine portion 32 and which thus provides an overall apparatus having the ease of packaging and stacking normally associated with three-ring binders. The system of the present invention allows complete protection of the ring binding 40 and sheets P, which discourages inadvertent sheet removal. In FIG. 2, the paper is preferably loaded beginning with the top, first or title page and ending with the rear, final or last page.

The present invention provides a paragon of simplicity, providing for lower costs of manufacture when compared even to three-ring binders, yet affording improved appearance and sheet security.

In view of the numerous modifications which could be made to the preferred embodiments disclosed herein without departing from the scope or spirit of the present invention, the details herein are to be interpreted as illustrative and not in a limiting sense.

What is claimed as invention is:

1. A binding apparatus for binding together sheets of perforated paper, each with correspondingly placed multiple openings along a margin thereof, comprising:

(a) a three panel one piece cover set including front and rear covers connected by a smaller cover spine portion with inner and outer surfaces and a longitudinal center line axis;

(b) a pair of parallel hinges defining respectively pivotal connections between each cover and the spine portion and generally parallel to the spine centerline;

(c) a plastic ring-type binder having a generally circular cross section, and including a curved back portion with a curvature greater than the curvature of the spine portion, and including an inner concave surface and an outer convex surface and parallel side portions, one side portion having a row of multiple, closely spaced flexible rings extending therefrom, each with a free end portion, the rings having a memory which returns them to assume a generally circular configuration after the rings are opened, such as during the addition of perforated paper thereto;

(d) an elongated adhesive bead member extending along the plastic back convex surface and positioned along the spine centerline, generally between the spine end portions and spaced away from the fingers so that the fingers can be opened for adding paper thereto, bonding the plastic ring-type binder to the cover adjacent the cover spine portion thereof, and without substantial migration of the bead to the cover set outer surface so that printed matter can be added to the cover spine portion outer surface without interference by the bead; and (e) the bead extending laterally toward the scores and providing spaced thicker portions away from the longitudinal centerline axis of the spine for bonding the plastic ring type binder to the spine as the different curvature of the ring-type binder and spine diverge away from the centerline.

2. A loose leaf binding system for binding together a variable number of sheets of paper, perforated with multiple openings along a margin, comprising:

(a) a cover set assembly with inside and outside surfaces, and including front and rear cover panels connected by a smaller cover spine panel portion with a longitudinal centerline axis;

(b) a pair of parallel hinges defining respectively pivotal connections between each cover and the spine portion, the hinges being spaced apart a preselected distance that defines the paper capacity or measured paper bulk;

(c) a plastic ring-type binder that can be of various cross-sectional sizes preselected based upon paper capacity or measured paper bulk, each having a curved back having an inner concave surface and an outer convex surface, and parallel side portions, one side portion of the ring-type binder having multiple closely spaced flexible rings extending therefrom each with a single free end portion, the rings having a memory which returns them to assume a generally circular configuration after the rings are opened during the addition of perforated paper thereto;

(d) connection means for affixing the plastic binder to the cover set assembly at the cover spine portion thereof before binding paper to the rings and being positioned on the inside surface of the cover set assembly in a position which allows the plastic binder and cover set assembly to be opened, so that margin perforated paper can be loaded upon the plastic rings of the plastic back cover assembly when the covers are folded rearwardly to a position that abuts the front and rear cover outside surfaces; and (e) the connection means including a bead of connecting material that extends longitudinally along the spine centerline and transversely toward the hinges and along the convex surface of the plastic ring-type binder so that the bead of material does not interfere with an opening of the flexible ring, the bead of material providing spaced-apart thicker portions on each side of the spine centerline for conforming to the curvatures of the plastic ring-type binder and the spine on each side of the spine centerline.

3. The apparatus of claim 2, wherein the covers can pivot upon the scores by a measure of one hundred eighty degrees (180°).

4. The apparatus of claim 2, wherein the connection means communicates with the inner surface of the cover spine portion.

5. The apparatus of claim 2, wherein the connection means is positioned between the convex surface of the plastic spine and the inner surface of the cover spine.

6. The apparatus of claim 5, wherein the connection means is positioned between the convex surface of the plastic spine, the inner surface of the cover spine and the end portions of the plastic spine.

7. The apparatus of claim 2, wherein the connection means includes a continuous bead.

* * * * *